US005936174A

United States Patent [19]

Liao

[11] Patent Number: 5,936,174

[45] Date of Patent: Aug. 10, 1999

[54] CYMBAL FIXATION DEVICE

[75] Inventor: Tsun-Chi Liao, Taichung, Taiwan

[73] Assignee: HWA Shin Musical Instrument Co., Ltd., Taichung, Taiwan

[21] Appl. No.: 09/048,013

[22] Filed: Mar. 26, 1998

[51] Int. Cl.[6] ..... G10D 13/06

[52] U.S. Cl. ..... 84/402; 84/403; 84/422.1

[58] Field of Search ..... 84/402–404, 422.1, 84/422.2

[56] References Cited

U.S. PATENT DOCUMENTS 4,898,061 2/1990 Cohen et al. ..... 84/402

5,367,939 11/1994 Barker ..... 84/402

*Primary Examiner*—William M. Shoop, Jr.
*Assistant Examiner*—Marlon T. Fletcher
*Attorney, Agent, or Firm*—Bacon & Thomas, PLLC

[57] ABSTRACT

A cymbal fixation device includes a wing nut threaded onto a threaded stem on a cymbal stand to fix a cymbal in place, a holding down block mounted in a chamber in the wing nut, a split locating pin inserted into a pin hole on the wing nut and a pin hole on the holding down block to hold the holding block in place, and a tightening up screw threaded into an oblique screw hole on the wing nut and stopped against a beveled bottom edge of the holding down block to force the holding down block into engagement with the threaded stem.

1 Claim, 5 Drawing Sheets

CYMBAL FIXATION DEVICE

BACKGROUND OF THE INVENTION

The present invention relates to a cymbal fixation device for fixing a cymbal to a cymbal stand, and more particularly to such a cymbal fixation device which uses a wing nut to fix the cymbal in place, a locating pin to hold a holding down block in the wing nut, and a tightening up screw to force the holding down block into engagement with the threaded stem of the cymbal stand.

Referring to FIG. 1, when a cymbal 5 is mounted on a threaded stem 3, which is connected to a cymbal stand 1 by an angle-adjustable connector 2, and retained between two rubber blocks 4 above a collar on the threaded stem 3, a wing nut 6 is threaded onto the threaded stem 3 to fix the rubber blocks 4 and the cymbal 5 to threaded stem 3. Because the wing nut 6 can be conveniently removed from the threaded stem 3 with the hand, the cymbal 5 can easily be stolen by thieves. If the wing nut 6 is loosened in order to increase the amplitude of oscillation of the cymbal 5, the wing nut 6 may be forced to fall out of the threaded stem 3 during playing.

SUMMARY OF THE INVENTION

It is one object of the present invention to provide a cymbal fixation device which does not fall from the stem of the cymbal stand when adjusting the amplitude of oscillation of the cymbal. It is another object of the present invention to provide a cymbal fixation device which effectively prevents the cymbal from being stolen by thieves. To achieve these and other objects of the present invention, there is provided a cymbal fixation device which comprises a wing nut threaded onto a threaded stem on a cymbal stand to fix a cymbal in place, a holding down block mounted in a chamber in the wing nut, a split locating pin inserted into a pin hole on the wing nut and a pin hole on the holding down block to hold the holding block in place, and a tightening up screw threaded into an oblique screw hole on the wing nut and stopped against a beveled bottom edge of the holding down block to force the holding down block into engagement with the threaded stem.

DETAILED DESCRIPTION OF THE PREFERRED EMBODIMENT

Figure 1:
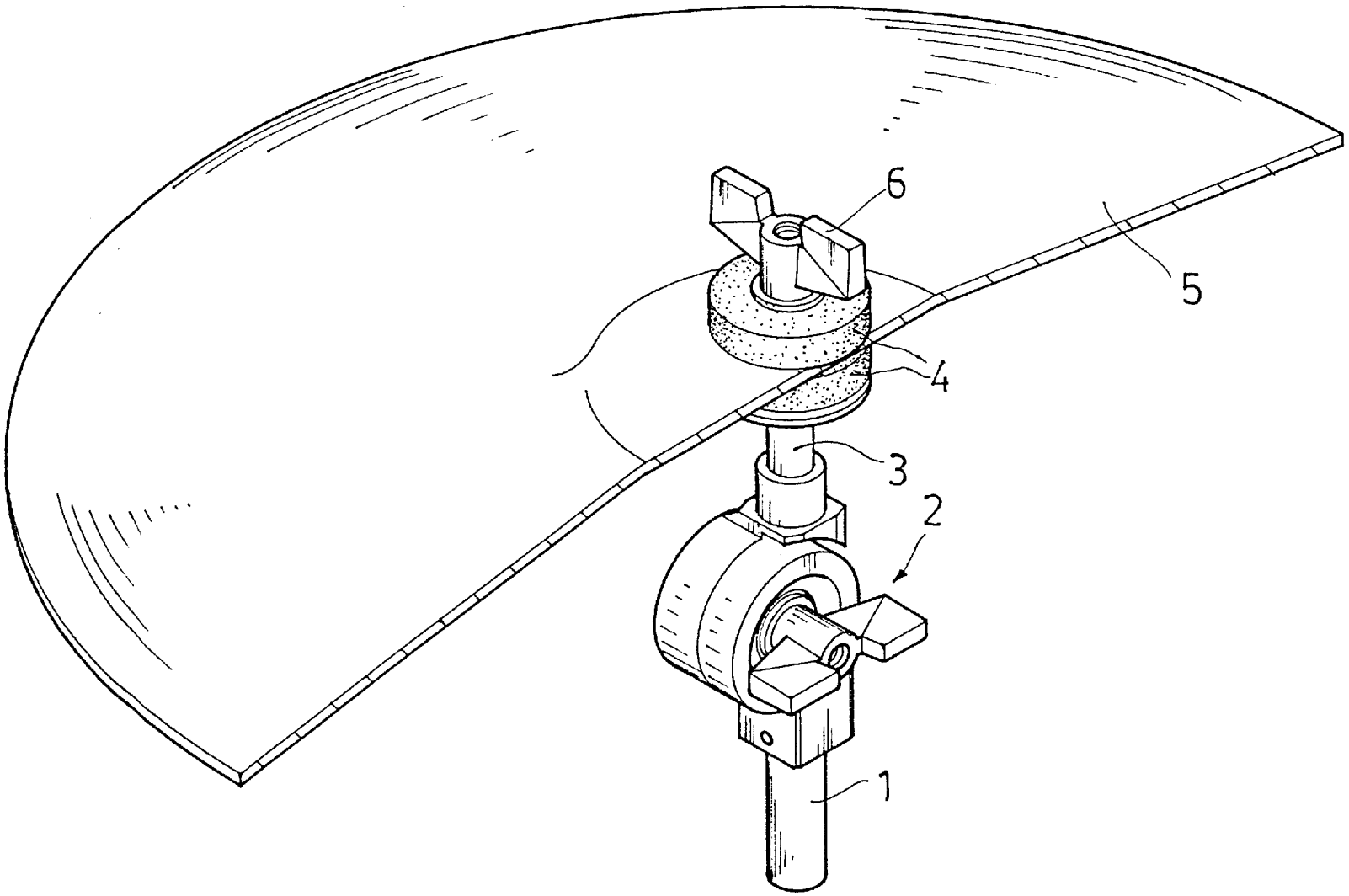
Fig.1 PRIOR ART
FIG. 1 is an installed view of a cymbal fixation device according to the prior art.
Figure 2:
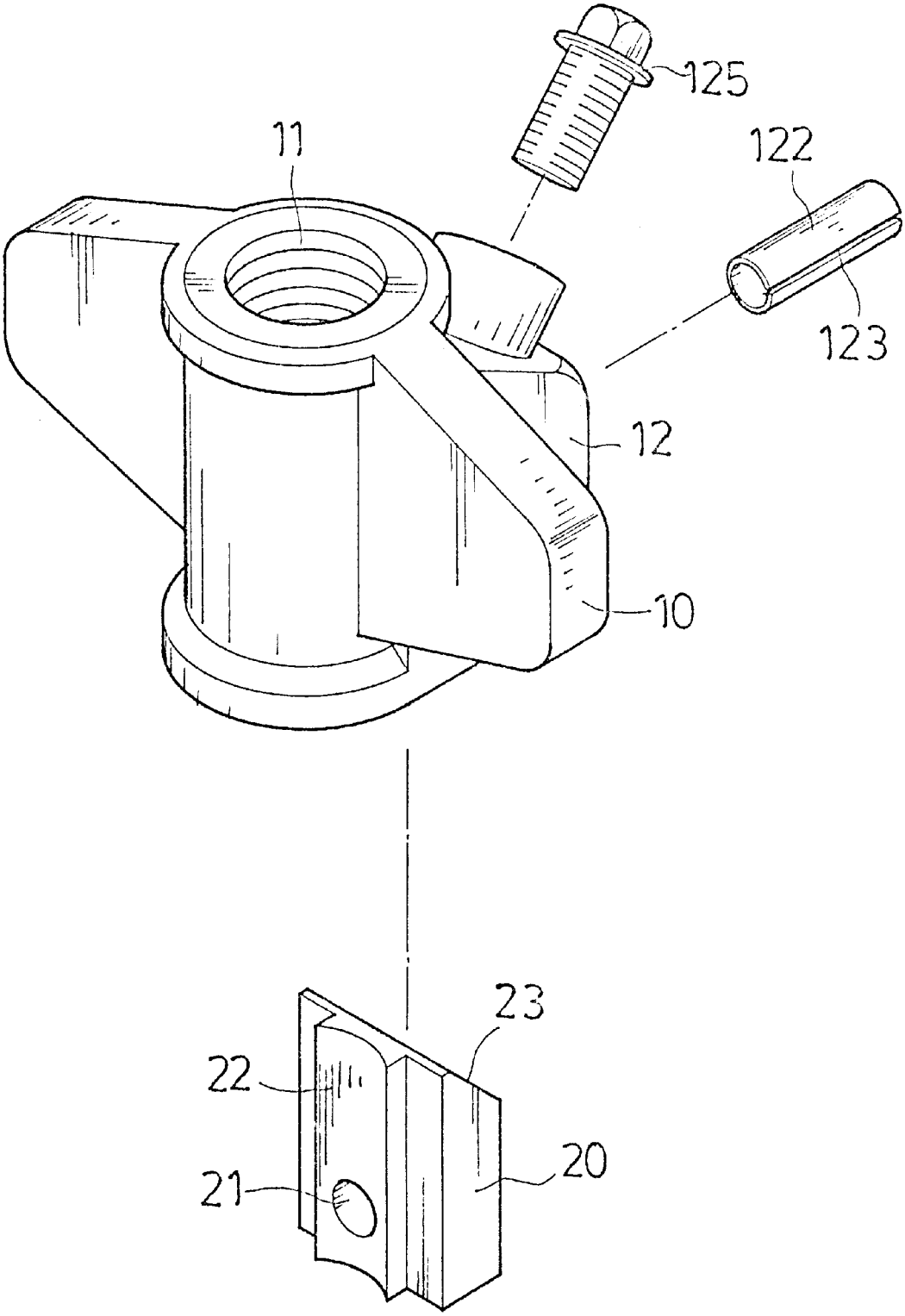
FIG. 2 is an exploded view of a cymbal fixation device according to the present invention.
Figure 3:
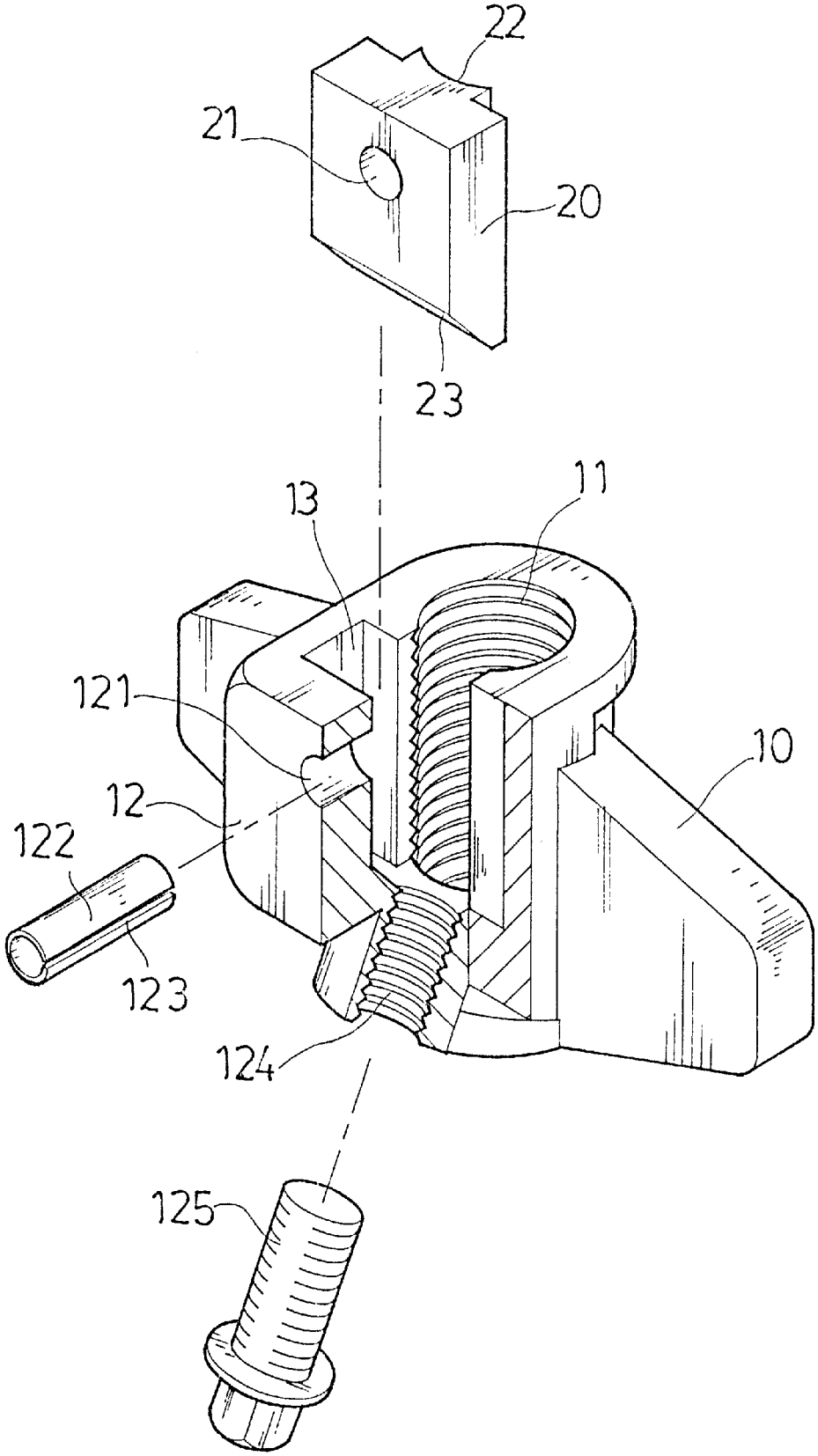
FIG. 3 is a cutaway view of the present invention.

Referring to FIGS. 2 and 3, a cymbal fixation device in accordance with the present invention comprises a wing nut 10, a holding down block 20, a split locating pin 122, and a tightening up screw 125. The wing nut 10 comprises an axial center screw hole 11, a projecting block 12 raised from one side thereof, an upwardly extended holding down block chamber 13 defined within the projecting block 12 in communication with the axial center screw hole 11 at one side for receiving the holding down block 20, an oblique screw hole 124 obliquely downwardly extended from the holding down block chamber 13, and a transverse pin hole 121 perpendicularly extended from the holding down block chamber 13 to an outer side of the projecting block 12. The holding down block 20 fits the holding down block chamber 13, having a transverse pin hole 21 corresponding to the transverse pin hole 121 on the wing nut 10, a beveled bottom edge 23, and a smoothly arched, longitudinally extended locating groove 22 at one side facing the axial center screw hole 11. The split locating pin 122 is inserted into the pin hole 121 on the wing nut 10 and the pin hole 21 on the holding down block 20 to secure the holding down block 20 in the holding down chamber 13. The split locating pin 122 has a longitudinal split 123. When the split locating pin 122 is radially inwardly compressed with the fingers, it can be conveniently inserted into the pin hole 121 on the wing nut 10 and the pin hole 21 on the holding down block 20. After insertion, the split locating pin 122 immediately returns to its former shape to secure the holding down block 20 firmly in the holding down chamber 13. The tightening up screw 125 is threaded into the oblique screw hole 124 and stopped against the beveled bottom edge 23 of the holding down block 20.

Figure 4:
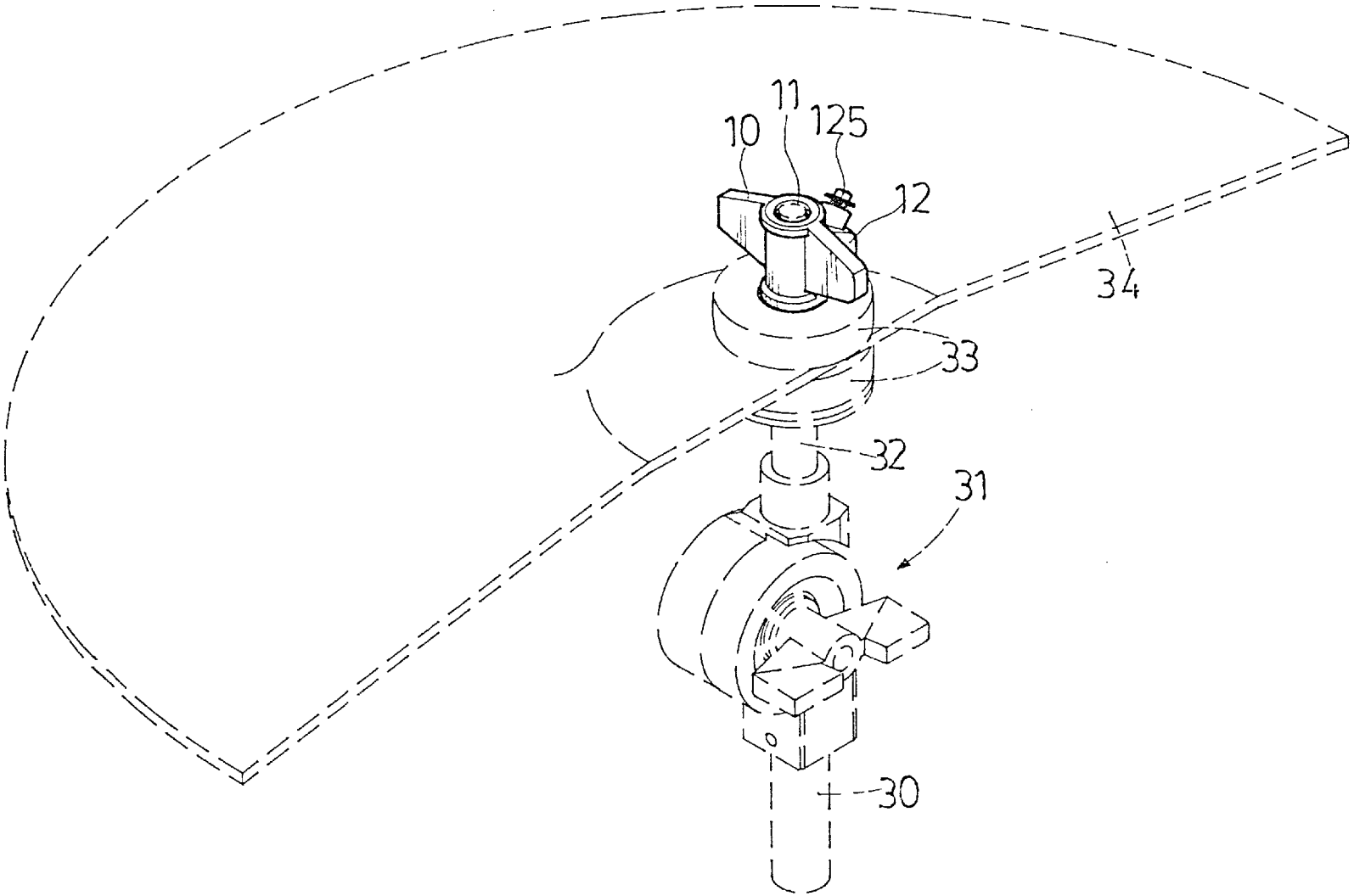
FIG. 4 shows an installation example of the present invention.

Referring to FIG. 4, a stem 32 is fastened to a cymbal stand 30 by an angle-adjustable connector 31; a cymbal 34 is retained between two rubber blocks 33 above a collar on the stem 32 (the structure of the cymbal stand 30 is of the known art and not within the scope of the present invention); the axial center screw hole 11 of the wing nut 10 is threaded onto the threaded top end of the stem 32 to fix the rubber blocks 33 and the cymbal 34 to the stem 32; the tightening up screw 125 is fastened tight to tightening up the holding down block 20, causing the locating groove 22 of the holding down block 20 to be forced into engagement with the threaded top end of the stem 32 tightly. When fastened tight, the wing nut 10 cannot be disconnected from the stem 32 without loosening the tightening up screw 125. Before playing the cymbal 34, the tightening up screw 125 is loosened from the holding down block 20, and then the wing nut 10 is slightly loosened, enabling the cymbal 34 to have a wide range of oscillation when played, so as to produce a better resonance. After adjustment, the tightening up screw 125 is fastened tight again to fix the holding down block 20 to the stem 32.

Figure 5:
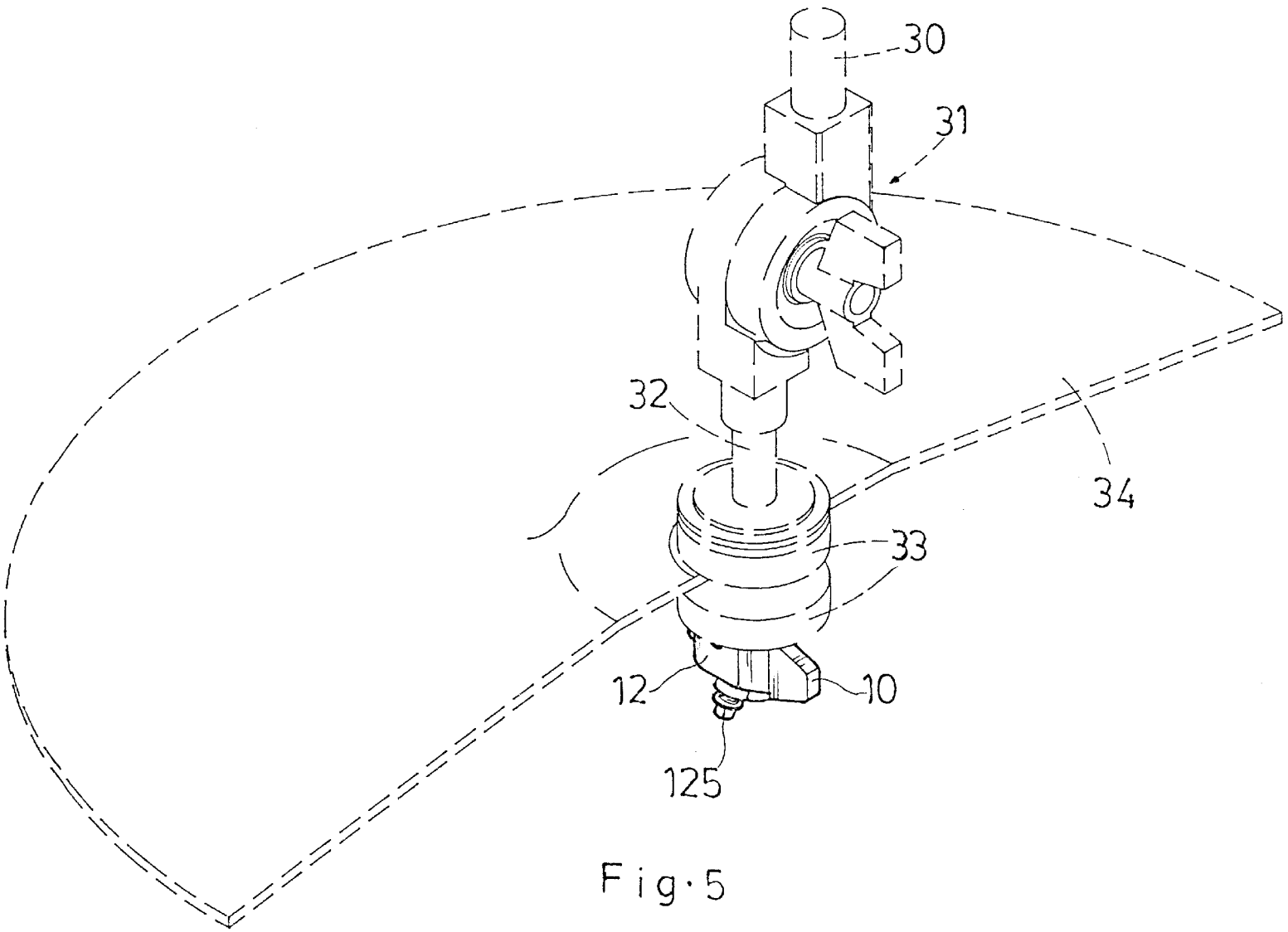
FIG. 5 shows another installation example of the present invention.

FIG. 5 shows another installation example of the present invention in which the cymbal 34 is hung upside-down. Because the cymbal 34 is hung upside-down, the angle-adjustable connector 31, the stem 32 and one rubber block 33 are disposed above the cymbal 34, the other rubber block 33 and the cymbal fixation device is disposed below the cymbal 34. When the tightening up screw 125 is fastened tight, the holding down block 20 is fixed to the stem 32, and the wing nut 10 is prohibited from rotation motion on the stem 32.

What the invention claimed is:

1. A cymbal fixation device comprising wing nut having an axial center screw hole for threading onto a threaded stem on a cymbal stand, wherein said wing nut comprises a projecting block at one side, an upwardly extended holding down block chamber defined within said projecting block in communication with said axial center screw hole at one side, an oblique screw hole obliquely downwardly extended from said holding down block chamber to a bottom side wall of said projecting block, and a transverse pin hole perpendicularly extended from said holding down block chamber to an outer side wall of said projecting block; a holding down block is mounted in said holding down block chamber, said holding down block having a transverse pin hole aligned with the transverse pin hole on said wing nut, a beveled bottom edge, and a smoothly arched, longitudinally extended locating groove at one side forced into engagement with said threaded stem; a split locating pin is inserted into the pin hole on said wing nut and the pin hole on said holding down block to secure said holding down block in said holding down chamber; a tightening up screw is threaded into said oblique screw hole on said wing nut and stopped against the beveled bottom edge of said holding down block to force the longitudinally extended locating groove of said holding down block into engagement with said threaded stem.

* * * * *